United States Patent [19]

DoMinh

[11] Patent Number: 4,548,897

[45] Date of Patent: Oct. 22, 1985

[54] PHOTOTHERMOGRAPHIC ELEMENT AND PROCESS

[75] Inventor: Thap DoMinh, Rochester, N.Y.

[73] Assignee: Eastman Kodak Company, Rochester, N.Y.

[21] Appl. No.: 615,615

[22] Filed: May 31, 1984

[51] Int. Cl.[4] ..... G03C 1/02

[52] U.S. Cl. ..... 430/351; 430/617; 430/542; 430/936

[58] Field of Search ..... 430/617, 351, 936, 542

[56] References Cited

U.S. PATENT DOCUMENTS

| | | | |
|---|---|---|---|
| 3,438,776 | 4/1969 | Yudelson | 430/617 |
| 4,308,341 | 12/1981 | DoMinh | 430/936 |
| 4,430,420 | 2/1984 | Adin | 430/617 |
| 4,469,773 | 9/1984 | Adin et al. | 430/620 |

*Primary Examiner*—Won H. Louie

*Attorney, Agent, or Firm*—Richard E. Knapp

[57] ABSTRACT

A silver image and dye image are provided in a photothermographic element comprising a support bearing, in reactive association, (A) a silver compound capable of forming a silver image, and (B) a dye-forming combination comprising (a) a cobalt (III) amine complex capable of releasing ammonia or an amine at processing temperature in the presence of silver and (b) an aromatic 1,2-dialdehyde capable of forming a dye upon reaction with an amine or ammonia. Improvements are provided in such an element by a cyclic imide melt former-silver solvent which is capable of promoting dye formation at processing temperature. A silver image and dye image are formed in such an exposed photothermographic element upon thermal processing. The photothermographic element optionally can comprise a dye image receiver layer.

11 Claims, No Drawings

PHOTOTHERMOGRAPHIC ELEMENT AND PROCESS

FIELD OF THE INVENTION

This invention relates to a photothermographic element comprising, in reactive association, (A) a silver compound, such as photographic silver halide, capable of forming a silver image, and (B) a dye-forming combination comprising (a) a cobalt (III) amine complex capable of releasing ammonia or an amine at processing temperature in the presence of silver and (b) an aromatic 1,2-dialdehyde capable of forming a dye upon reaction with an amine or ammonia, and (C) a cyclic imide melt former-silver solvent which is capable of promoting dye formation at processing temperature. It also relates to formation of a silver image and dye image in such an exposed photothermographic element, preferably a dye image that amplifies a silver image, by thermal processing.

BACKGROUND OF THE INVENTION

Photothermographic materials are well known in the photographic art. Photothermographic materials are also known as heat developable photographic materials. The photothermographic materials after imagewise exposure are heated to moderately elevated temperatures to produce a developed image without the need for processing solutions or baths. Examples of known photothermographic materials are described in, for example, *Research Disclosure*, Vol. 170, June 1978, Item No. 17029.

Photographic materials for producing silver images and dye images are also well known. For example, a photothermographic element for producing a silver image and dye image is described in *Research Disclosure*, Vol. 185, September 1979, Item No. 18535. In such a photothermographic element a reducible organic silver salt upon heating in a first silver image-forming layer is reduced in the exposed areas of the photothermographic element and releases at least part of the salt anion which transfers to a second cobalt (III) amine complex containing layer. The salt anion which transfers to the second layer is believed to initiate a dye-forming reaction between the cobalt (III) amine complex and phthalaldehyde. The photothermographic element does not involve or suggest a melt former-silver solvent which is capable of promoting dye formation more efficiently in photothermographic elements designed to produce silver images and dye images involving photographic silver salts and cobalt (III) amine complexes.

Cyclic imides, such as succinimide, have been used in photothermographic silver halide materials as toners, such as described in *Research Disclosure*, Vol. 170, June 1978, Item No. 17029 to help provide a more neutral (black) silver image. However, such photothermographic silver halide materials have not involved such cyclic imides to aid dye formation.

SUMMARY OF THE INVENTION

It has been found that a silver image and a dye image, preferably a dye image that enhances a silver image, are provided effectively by means of a melt former-silver solvent in a photothermographic element comprising a support bearing, in reactive association, (A) a silver compound, preferably photographic silver halide, capable of forming a silver image, and (B) a cobalt imaging combination comprising (i) a cobalt compound, preferably a cobalt (III) amine complex, capable of thermally releasing ammonia or an amine imagewise in the presence of silver, and (ii) an aromatic 1,2-dialdehyde capable of reacting with ammonia or an amine to form a dye.

The melt former-silver solvent is a cyclic imide, preferably hydantoin or substituted hydantoin, capable of promoting dye formation in the photothermographic element at processing temperature within the range of about 80° C. to about 200° C.

The cobalt (III) amine complex is reduced by the developed silver in the exposed photothermographic element upon thermal processing. Amine or ammonia is released from the cobalt (III) amine complex during thermal processing which enables dye formation by reaction of the released amine or ammonia with the aromatic 1,2-dialdehyde. A silver image, which is preferably amplified by dye formed in the photothermographic element, is also formed upon thermal processing. The cyclic imide melt former-silver solvent is believed to help provide during such processing both a medium in which the dye-forming reaction can better occur and silver solvent action which aids silver image formation.

A silver image and dye image, preferably a silver image amplified by the dye image, according to the invention are formed by heating the exposed photothermographic element to processing temperature, such as a temperature within the range of about 80° C. to about 200° C. until the silver image and dye image are formed.

DETAILED DESCRIPTION OF THE INVENTION

Any cyclic imide melt former-silver solvent capable of promoting dye formation in the heat developable image recording element of the invention is useful. The cyclic imide melt former-silver solvent must be capable of promoting dye formation at processing temperature within the range of about 80° C. to about 200° C. The cyclic imide melt former-silver solvent is preferably a compound represented by the formula:

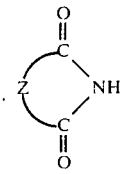

wherein Z represents the atoms necessary to complete a substituted or unsubstituted hydantoin compound. Highly preferred cyclic imide melt former-silver solvents are 5,5-diphenylhydantoin, 5,5-dimethylhydantoin and hydantoin, or combinations of such cyclic imide melt former-silver solvents. Combinations of cyclic imide melt former-silver solvents are also preferred.

The term substituted hydantoin compound herein means a cyclic imide melt former-silver solvent which is a hydantoin compound containing substituent groups which do not adversely affect the melt-forming capability, silver solvent capability and dye formation promoting capability of the cyclic imide compound. Useful substituent groups include, for example, aryl groups, such as phenyl and alkyl groups, such as methyl and ethyl.

The terms "alkyl" and "aryl" herein include unsubstituted alkyl such as unsubstituted methyl, ethyl, propyl and butyl, and unsubstituted aryl, such as unsubstituted phenyl. The terms also include alkyl and aryl that are substituted by groups which do not adversely affect the desired properties of the heat developable image recording elements. Examples of useful substituted alkyl groups include alkyl substituted by chloro, bromo or alkoxy. Examples of useful substituted aryl include chlorophenyl, bromophenyl and alkoxyphenyl. Aryl herein includes alkaryl such as benzyl and xylyl.

An optimum cyclic imide melt former-silver solvent will depend upon such factors as the desired image, particular heat developable image recording element, processing steps and conditions, particular photographic compound in the heat developable image recording element, and particular cobalt imaging combination.

The cyclic imide melt former-silver solvents are known compounds which can be prepared by methods known in the organic compound synthesis art.

The hue of the dye formed in a heat developable image recording element as described varies, depending upon such factors as the particular components of the heat developable image recording element, processing conditions, and the particular silver compound which is useful for forming a silver image in the recording element. The hue of the dye formed is preferably neutral (black) and augments the image comprising the silver compound in the image recording element.

Generally, the components of the heat developable image recording element prior to processing are colorless. Some of the components have a slight color in the heat developable image recording element prior to exposure and processing. This slight color is not considered unacceptable.

The heat developable image recording element comprises a photographic component, preferably a photographic silver compound capable of forming a silver image. A preferred photographic silver compound is photographic silver halide. It is essential that the photographic component not adversely affect the desired imaging process, including the dye formation process according to the invention. Examples of useful photographic silver halides are silver chloride, silver bromide, silver bromoiodide, silver chlorobromoiodide, silver iodide and mixtures thereof. The photographic silver halide is generally present in the heat developable image recording element in the form of an emulsion which is a dispersion of the photographic silver halide and a useful binder. The photographic silver halide is present in a range of grain sizes from fine grain to coarse grain. The composition containing the photographic silver halide is prepared by any of the well known procedures in the photographic art, such as described in *Research Disclosure*, December 1978, Item No. 17643. Tabular grain photographic silver halide is also useful in a heat developable image recording element as described. Such tabular grain photographic silver halide is described in, for example, *Research Disclosure*, January 1983, Item No. 22534, the disclosure of which is incorporated herein by reference. The photographic silver halide materials can contain addenda commonly present in photographic silver halide materials, such as chemical sensitizers, brighteners, antifoggants, emulsion stabilizers, light absorbing or scattering materials, hardeners, coating aids, plasticizers, lubricants and antistatic materials, matting agents, development modifiers and other addenda described in, for example, *Research Disclosure*, December 1978, Item No. 17643. The photographic silver halide can comprise, for example, internal image photographic silver halide and internally sensitized covered grain silver halide to produce positive images.

The photographic silver halide is generally spectrally sensitized by means of spectral sensitizing dyes, as described in *Research Disclosure*, December 1978, Item No. 17643. Spectral sensitizing dyes which are useful in the photographic materials include polymethine sensitizing dyes which include the cyanines, merocyanines, complex cyanines and merocyanines (including tri-, tetra- and polynuclear cyanines and merocyanines), as well as oxonols, hemioxonols, styryls, merostyryls and streptocyanines. Combinations of spectral sensitizing dyes are useful.

The heat developable image recording element contains a range of concentrations of photographic silver halide. An optimum concentration of photographic silver halide will depend upon such factors as the desired image, processing conditions, particular components of the heat developable image recording element and the particular dye formed. A useful concentration of photographic silver halide in the heat developable image recording element is within the range of about 2 grams to about 20 grams of photographic silver halide per 100 grams of binder in the heat developable image recording element. The coverage of photographic silver halide is generally less than otherwise might be useful due to the enhancing properties of the dye formed upon processing of the recording element.

The components of the heat developable image recording element are in any location in the element which produces the desired silver image and dye image upon processing. The cyclic imide melt former-silver solvent is in a location with respect to the photographic silver halide and the cobalt imaging combination that produces a silver image and a useful dye image upon appropriate processing. If desired, a portion of the melt former-silver solvent is in a layer contiguous to the layer containing photographic silver halide. The term "in reactive association" herein means that the silver compound capable of forming a silver image, preferably photographic silver halide, and the remaining components of the heat developable image recording element are in a location with respect to each other which enables the heat developable image recording element upon processing to produce a useful silver image and dye image.

Any silver halide developing agent in a photothermographic element as described is useful that provides effective silver image development upon thermal processing and does not adversely affect the described cobalt imaging combination. A highly useful silver halide developing agent is a developing agent from a hindered phenol developing agent precursor or blocked hydroquinone developing agent precursor or combination thereof. Such a developing agent is in oxidized form a weaker oxidizing agent than a cobalt (III) hexammine salt. The developing agent is also capable at thermal processing temperature of enabling development of exposed photographic silver halide grains. Hydroquinone is not a useful developing agent in the described photothermographic materials because the oxidized form which is benzoquinone is an oxidizing agent having oxidizing properties that are too strong compared to the oxidizing properties of $Co(NH_3)_6^{+3}$. The preferred developing agents in the described photothermographic materials do not provide quinones upon thermal processing.

Examples of useful developing agent precursors are represented by the formulas:

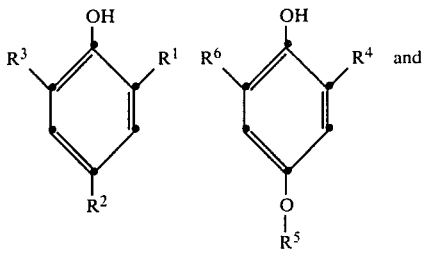

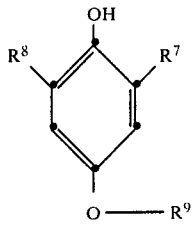

wherein $R^3$, $R^6$, $R^7$ and $R^8$ are individually hydrogen or alkyl, preferably alkyl containing 1 to 20 carbon atoms, such as methyl, ethyl, propyl, butyl, decyl and eicosyl;

$R^1$ is alkyl, preferably alkyl containing 1 to 5 carbon atoms, such as methyl, ethyl, propyl, n-butyl, t-butyl and pentyl;

$R^2$ is hydrogen or a substituent which does not adversely affect the developing action of the developing agent, such as alkyl, preferably alkyl containing 1 to 20 carbon atoms, for example methyl, ethyl, propyl, butyl, decyl and eicosyl; alkoxy, preferably containing alkoxy containing 1 to 5 carbon atoms, such as methoxy, ethoxy, propoxy and butoxy; or pentoxy;

$R^4$ and $R^5$ are alkyl, preferably alkyl containing 1 to 20 carbon atoms, such as methyl, ethyl, propyl, butyl, octyl, decyl and eicosyl;

$R^9$ represents the carbon atoms necessary to complete an unsubstituted or substituted heterocyclic ring, preferably a 5 or 6 member heterocyclic ring, such as

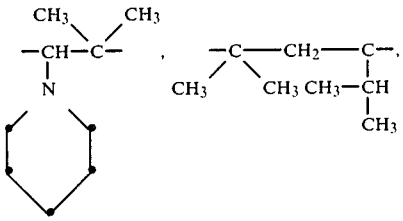

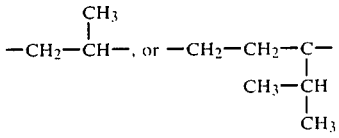

Examples of useful silver halide developing agents are as follows:

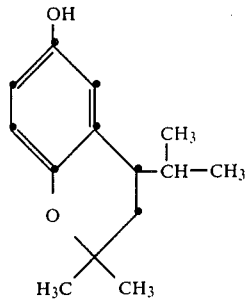

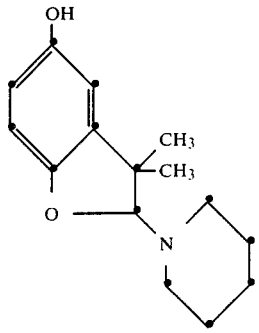

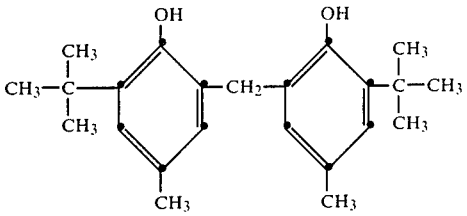

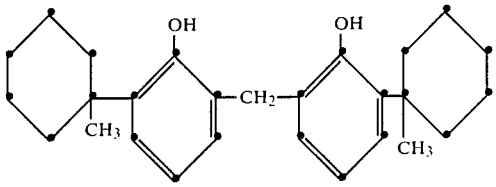

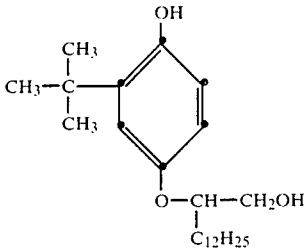

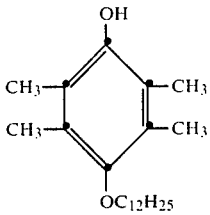

-continued

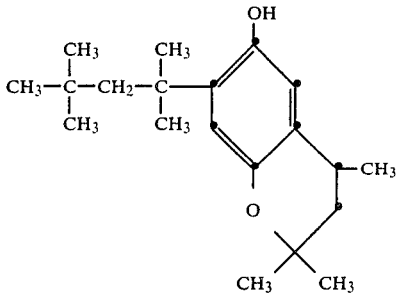

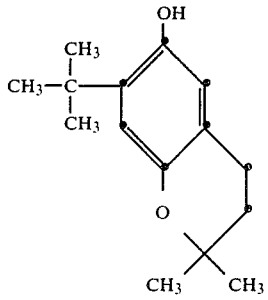

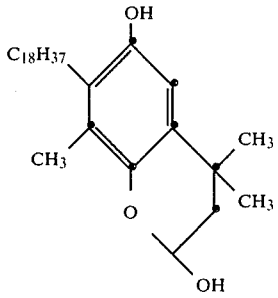

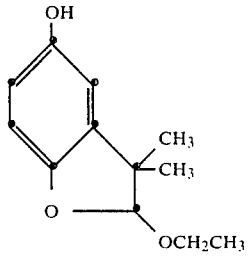

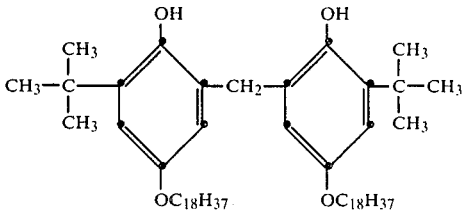

Many other optional developing agents are useful for aiding in developing an image in a heat developable image recording element as described. Other examples of useful developing agents are described in, for example, *Research Disclosure*, June 1978, Item No. 17029, the description of which is incorporated herein by reference. Combinations of silver halide developing agents are also useful. The silver halide developing agent or developing agent combination is usefully incorporated in the photographic material.

The term "developing agent" herein includes compounds which are developing agents and developing agent precursors. That is, those compounds are included which are not developing agents in the photographic material until a condition occurs, such as contact with an activator for the photographic material.

The tone of the image, such as the tone of the silver image and dye image, produced in the recording element varies depending upon such factors as the silver morphology of the silver image, the covering power of the silver materials, the particular dye formed, processing conditions, concentration of components, and other materials present during imaging. In the photographic materials that provide a brown silver image, a dye produced from the cobalt imaging combination is especially useful which is complimentary in hue to the silver image.

The heat developable image recording element generally comprises at least one binder. Binders are useful alone or in combination in the recording element. Useful binders in the element include both naturally occuring substances such as proteins, for example, gelatin, gelatin derivatives, cellulose derivatives, polysaccharide such as dextran, gum arabic and the like; and synthetic polymeric materials which are compatible with the silver compound and the cobalt imaging combination such as cellulose acetate butyrate, polysulfonamide, poly(vinyl butyral) and polyvinylpyrrolidine.

If desired, the heat developable image recording element contains an overcoat layer and/or interlayer and/or subbing layer to provide desired properties. The overcoat layer, for example, increases resistance to abrasion and other markings on the element. The overcoat layer, interlayer or subbing layer contain, alone or in combination, vehicles and binders that are useful in the layer of the element containing the photosensitive silver halide.

The heat developable image recording element comprises a variety of supports. Useful supports include those which are resistant to adverse changes in structure due to processing conditions and which do not adversely affect the desired sensitometric properties of the element. Useful supports include, for example, cellulose ester, poly(vinylacetal), poly(ethylene terephthalate) and polycarbonate films, as well as related films and resinous materials. Glass, paper, metal and the like supports are also useful. A flexible support is generally most useful.

In preparing the heat developable image recording element, a dispersion solvent is optionally useful to produce a coating composition. A coupler solvent known in the photographic art is optionally useful for aiding dispersion of the components. Examples of optional coupler solvents include N-n-butylacetanilide, diethyl lauramide, di-n-butylphthalate and 2,4-ditertiaryamylphenol. The compounds are also optionally loaded into a latex, or a non-solvent dispersion is prepared if desired.

The components of the recording element are coated on a support by procedures known in the photographic art. Such procedures include, for example, immersion or dip coating, roller coating, reverse roll coating, air knife coating, doctor blade coating, spray coating, extrusion coating, dip coating, stretch flow coating and curtain coating.

The heat developable image recording element is generally imagewise exposed by means of various forms of energy to produce a developable image. Such forms of energy include those to which the recording element, especially the photographic silver halide in the element, is sensitive. These forms of energy encompass the ultraviolet, visible and infrared regions of the electromagnetic spectrum, as well as electron beam and beta radiation, gamma ray, x-ray, alpha particle, neutron radiation and other forms of corpuscular wavelength radiant energy in either noncoherent (random phase) forms or coherent (inphase) forms as produced by lasers. Exposures are monochromatic, orthochromatic or panchromatic, depending upon the spectral sensitization of the recording element, especially the photographic silver halide. Imagewise exposure is generally for a sufficient time and intensity to produce a developable image in the recording element.

The described recording element is processed in a process which produces a silver image and dye image in the recording element. The photographic silver halide contained in the recording element is optionally processed following exposure by means of an aqueous alkaline medium in the presence of a silver halide developing agent contained in the medium or in the element according to the invention. Subsequent to formation of the silver image, the cobalt imaging combination can be brought into contact with the silver image and the resulting assemblage processed to form a dye image and silver image.

The cobalt imaging combination comprises a cobalt compound capable of thermally releasing ammonia or an amine imagewise in the presence of silver. The cobalt imaging combination also comprises an aromatic 1,2-aldehyde capable of reacting with ammonia or an amine to form a dye. A preferred cobalt compound in such a cobalt imaging combination comprises at least one cobalt (III) complex. Such cobalt (III) complex materials are known in the imaging art and are described in, for example, *Research Disclosure*, Item No. 16845; *Research Disclosure*, Item No. 12617; *Research Disclosure*, Item No. 18535; *Research Disclosure*, Item No. 15874; *Research Disclosure*, Item No. 18436; U.S. Pat. No. 4,273,860; U.K. Published Application No. 2,012,445A; European Patent No. 12,855; and Published Application WO 80/01322, the diclosures of which are incorporated herein by reference.

Preferred cobalt (III) complexes useful in the heat developable image recording element feature a molecule having a cobalt atom or ion surrounded by a group of atoms, ions or other molecules which are generically referred to as ligands. The cobalt atom or ion in the center of these complexes is Lewis acid while the ligands are Lewis bases. Trivalent cobalt complexes, that is cobalt (III) complexes, are generally most useful because the ligands are relatively tenaciously held in these complexes and released when the cobalt is reduced to the (II) state. Preferred cobalt (III) complexes are those having a coordination number of 6. A wide variety of ligands are useful to form a cobalt (III) complex which is capable of thermally releasing ammonia or an amine imagewise. Cobalt (III) complexes which rely upon chelation of cobalt (II) to form added dye density are also useful in recording elements as described. Useful amine ligands in cobalt (III) complexes include, for example, methylamine, ethylamine, ammines and amino acids such as glycinato. The term "ammine" refers to ammonia, when functioning as a ligand, whereas "amine" indicates the broader class noted above. The ammine complexes are highly useful in producing dye images in a recording element as described.

The image recording element as described containing a cobalt (III) complex optionally comprises other addenda which aid in imaging. Such addenda include, for example, dye forming materials or dyes which are bleachable in response to ammonia or amines. Examples of dye forming materials which also comprise destabilizer materials to interact with the cobalt (III) complex are known in the photographic art such as described in U.S. Pat. No. 4,273,860, the disclosure of which is incorporated herein by reference. Such dye forming materials include, for example, 4-methoxynaphthol which forms a blue dye when oxidized and protenated diamine destabilizer material which when associated with a conventional color coupler will form a dye when it is oxidized by the reduction of the cobalt (III) complex. Examples of image forming materials useful in addition to a destabilizer material include an ammonia-bleachable or color alterable dye, such as a cyanine dye, styryl dye, rhodamine dye, azo dye or pyrylium dye; a dye precursor such as ninhydrin; or a diazo coupler material which is capable of forming a diazo dye. Details of these examples are described in, for example, *Research Disclosure*, October 1974, Item No. 12617, the disclosure of which is incorporated herein by reference. Another optional addenda is a compound which will chelate with the cobalt (II) to form a dye.

When ammonia-bleachable image forming materials are present in the recording element, the ammonia-bleachable materials are preferably in a layer separate from the ammonia producing components of the recording element.

The cobalt imaging combination preferably comprises a binder which is the same or different from the binder for the silver compound. Useful binders for the cobalt imaging combination are described in, for example, *Research Disclosure*, October 1974, Item No. 12617, the description of which is incorporated herein by reference. Useful binders for the cobalt imaging combination include acetates, cellulose compounds, vinyl polymers, polyacrylates and polyesters. In addition, it is preferred that the binder be selected which will maximize the preferred hue and density of the dye produced upon exposure and processing. Preferred examples of binders for the cobalt imaging combination include polysulfonamides, for example, poly(ethylene-co-1,4-cyclohexylenedimethylene, 1-methyl-2,4-benzenedisulfonamide), poly(ethylene-co-hexamethylene-1-methyl-2,4-benzenedisulfonamide), and poly(methylacrylonitrile).

A preferred cobalt imaging combination comprises, in a sulfonamide binder, a cobalt (III) hexammine complex, such as a trifluoroacetate complex, and phthalaldehyde.

Another embodiment of the invention is a heat developable imaging assemblage comprising a support bearing, in reactive association, (I) a layer comprising, in a binder, a cobalt imaging combination comprising (i) a cobalt (III) amine complex, with (ii) an aromatic 1,2-dialdehyde capable of reacting with ammonia or an amine to form a dye and (II) a layer comprising a silver image; wherein the assemblage comprises a cyclic imide melt former-silver solvent capable of promoting dye formation in the element at a temperature within the range of about 80° C. to about 200° C. The layer comprising a silver image can be a photothermographic material such as a photothermographic silver halide material. Photothermographic silver halide materials are described in, for example, *Research Disclosure*, June 1978, Item No. 17029, the disclosure of which is incorporated herein by reference.

The silver image can be formed from a photothermographic material which is imagewise exposed to light to provide a developable latent image which is then developed by merely uniformly heating the photothermographic material to processing temperature prior to laminating the photothermographic material containing the silver image to the layer comprising the cobalt imaging combination. After lamination the imaging assemblage can then be heated to processing temperature within the range of about 80° C. to about 200° C. to enable the cyclic imide melt former-silver solvent to initiate dye formation to augment the silver image. The ammonia or amine released from the cobalt (III) amine complex is generally transferred to the contiguous silver image layer containing the silver image as well as aiding in dye formation by reaction with the aromatic 1,2-dialdehyde in the cobalt imaging combination.

The layer comprising the silver image can be a photothermographic material known in the art as a dry physical development material or a dry chemical development material as described in *Research Disclosure*, June 1978, Item No. 17029. The dry physical development photothermographic material can comprise, for example, a variety of organic silver salt oxidizing agents. Examples of organic silver salt oxidizing agents are described in *Research Disclosure*, June 1978, Item No. 17029. Examples of useful organic silver salt oxidizing agents include silver behenate, silver palmitate, silver stearate, and combinations thereof. Other useful silver salts include silver salts of 1,2,4-mercaptotriazole derivatives and complexes or salts of silver with a nitrogen acid, such as a nitrogen acid selected from the group consisting of imidazole, pyrazole, urazole, 1,2,4-triazole and 1H-tetrazole nitrogen acids or combinations of these acids. Selection of an optimum organic silver salt oxidizing agent or combination of such oxidizing agents, will depend upon such factors as the desired image, particular silver halide, processing conditions and the particular cobalt imaging combination.

The terms "salt" and "complex" herein include any type of bonding or complexing mechanism which enables the resulting recording element to provide desired imaging properties. In some instances the exact bonding of the described salt or complex is not fully understood. The terms "salt" and "complex" are intended to include neutral complexes and non-neutral complexes.

A process of forming a silver image and dye image in a heat developable image recording element comprises heating the element, preferably uniformly, to a temperature within the range of about 80° C. to about 200° C. until the image is formed. During this heating step ammonia or an amine is released from the cobalt imaging combination. The ammonia or amine aids formation of an image.

Heating of a heat developable image recording element is carried out until a desired image is formed, typically within about 2 to about 60 seconds. Selection of an optimum time and temperature will depend upon such factors as the desired image, particular components of the recording element, the particular cobalt imaging combination and the particular melt former-silver solvent.

A variety of means are useful to produce the necessary heating of the heat developable image recording element or assemblage to develop the desired image. The heating means is, for example, a hot plate, heated drum, iron, or roller, infrared heating means, hot air heating means, microwave heating means or the like.

Processing is generally carried out under ambient conditions of pressure and humidity. Pressures and humidity outside normal atmospheric conditions are useful if desired; however, atmospheric conditions are preferred.

It is generally desirable to have a stabilizer or stabilizer precursor in the element to provide improved post-processing image stability for the silver image. It is desirable in most instances to stabilize the silver halide after processing in order to avoid post-processing print-up. A variety of stabilizers and stabilizer precursors are useful in the recording element. The stabilizers and stabilizer precursors are useful alone or in combination. Generally useful stabilizers and stabilizer precursors are sulphur compounds that form a stable silver mercaptide after image development at processing temperatures. Photolytically active halogenated organic compounds are also useful in some recording elements. Such stabilizers and stabilizer precursors are described in, for example, *Research Disclosure*, June 1978, Item No. 17029. Selection of an optimum stabilizer or stabilizer precursor or combination thereof will depend upon such factors as the desired image, particular photosensitive silver halide, processing conditions, and particular cobalt imaging combination.

The following examples are included for a further understanding of the invention. In these examples the use of the hydantoin compounds as melt former-silver solvents provides improved results contrary to what might have been expected in light of the fact that 5,5-diphenylhydantoin was disclosed in, for example, *Research Disclosure*, August 1979, Item No. 18436 (page 448); *Research Disclosure*, December 1980, Item No. 20020; and *Research Disclosure*, May 1981, Item No. 20534 as a foggant for image forming combinations containing phthalaldehyde and cobalt (III) amine complexes.

EXAMPLE 1

This illustrates the invention.

The following coating solution was prepared by mixing the listed components:

poly(ethylene-co-1,4-cyclohexalenedimethylene-1-methyl-2,4-benzenedisulfonamide (15% W/W in acetone) (binder): 10.0 g cobalt (III) hexamminetrifluoroacetate: 0.240 g phthalaldehyde: 0.400 g 5,5-diphenylhydantoin (melt former-silver solvent): 0.120 g surfactant (Surfactant 10G; nonylphenoxypolyglycidol; a trademark of and available from the Olin Corporation, U.S.A.): 0.050 g (W/W herein means weight % by weight)

After all of the listed components were thoroughly dissolved, 20 mg of a 0.06 micron silver bromoiodide poly(vinyl butyral) emulsion were added and thoroughly mixed. The silver bromoiodide emulsion contained 42.55 grams of silver per liter of emulsion (2.22 kg of emulsion per silver mole) with a specific gravity of 0.875. The silver bromoiodide emulsion contained the silver bromoiodide grains peptized in 10% W/W poly(vinyl butyral) and acetone. The resulting coating was coated on a subbed poly(ethylene terephthalate) film support at 16° C. at a 0.1 mm (4 mil) wet coating thickness. The resulting coating was permitted to dry at 60° C. for 10 minutes. The resulting heat developable image recording element was imagewise exposed for 2 seconds through a 1.0 neutral density filter in a commercial light exposing device to produce a silver image in the element. Then the exposed element was processed by uniformly heating the element for 10 seconds at 120° C. on a hot block to produce a negative high density black image having a density in the maximum density areas of greater than 3.0.

EXAMPLE 2

This illustrates a two layer format for an element according to the invention.

A coating was prepared identical to that in Example 1 except that the silver bromoiodide emulsion was diluted by adding 1 volume of acetone and the resulting emulsion was coated as an overcoat over the layer containing the cobalt (III) hexammine trifluoroacetate at a 0.05 mm (2 mil) wet coating thickness. After drying the resulting two layer image recording element was imagewise exposed and processed as in Example 1 yielding a negative high density black image having a maximum density greater than 3.0.

EXAMPLE 3

This is a comparative example.

A single layer coating identical to that of Example 1 was prepared, except that the 5,5-diphenylhydantoin was omitted. This coating was imagewise exposed and processed in the same way as the element of Example 1. The results indicated that a much longer exposure was required to give a sensitometric result comparable to that of the results of the element of Example 1.

EXAMPLE 4

This is a comparative example.

A two layer coating identical to that of Example 2 was prepared, imagewise exposed and processed as described in Example 1 with the exception that the 5,5-diphenylhydantoin was omitted from the silver overcoat. The results indicated that the element of this example required much longer exposure time to produce sensitometric results comparable to that of Example 2.

The following examples can also be carried out:

EXAMPLE 5

A heat developable image recording element can be prepared as follows:

A cobalt imaging composition can be prepared by thoroughly mixing the following components:

poly(ethylene-co-1,4-cyclohexalenedimethylene-1-methyl-2,4-benzenedisulfide (15% W/W in acetone) (binder): 10.0 g
cobalt (III) hexammine trifluoroacetate: 0.240 g
phthalaldehyde: 0.400 g
5,5-diphenylhydantoin (melt former-silver solvent): 0.120 g
surfactant (Surfactant 10G; nonylphenoxypolyglycidol; a trademark of and available from the Olin Corporation, U.S.A.): 0.050 g The resulting composition (layer I) was coated on a poly(ethyleneterephthalate) film support. An interlayer of poly(acrylamide-co-N-vinyl-2-pyrrolidone-co-acetoacetoxyethyl methacrylate) (layer II) can be coated on layer I. A third layer (layer III) can be coated on layer II. Layer III can be prepared by mixing a silver bromoiodide poly(vinyl butyral) emulsion (as described in Example 1) with silver behenate in poly(vinyl butyral), phthalazinone (toner), mercuric chloride (antifoggant), acetone (solvent), cobalt (III) hexammine trifluoroacetate, and a developing agent precursor represented by the formula:

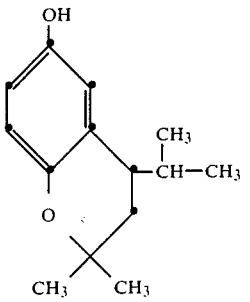

The resulting element can be imagewise exposed to light to produce a developable latent image in the element. Then a silver image and dye image can be formed in the element by heating the element to processing temperature within the range of about 80° to about 200° C. until the silver image and dye image are formed.

EXAMPLE 6

The procedure described in Example 5 can be repeated with the exception that the developing agent precursor described in Example 5 can be replaced by a developing agent precursor represented by the following formula:

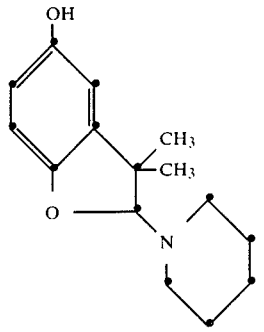

A silver image and dye image can be formed as in Example 5 after imagewise exposure to light by heating the exposed element to processing temperature within the range of about 80° to about 200° C. until the silver image and dye image are formed.

The invention has been described in detail with particular reference to preferred embodiments thereof, but it will be understood that variations and modifications can be effected within the spirit and scope of the invention.

What is claimed is:

1. In a heat developable image recording element comprising a support bearing, in reactive association, (a) a silver compound capable of forming a silver image, and (b) a cobalt imaging combination comprising (i) a cobalt compound capable of thermally releasing ammonia or an amine imagewise in the presence of silver, and (ii) an aromatic 1,2-dialdehyde capable of reacting with ammonia or an amine to form a dye, the improvement comprising (c) a cyclic imide melt former-silver solvent capable of promoting dye formation in said element at processing temperature within the range of about 80° C. to about 200° C. wherein said cyclic imide melt former-silver solvent is represented by the formula:

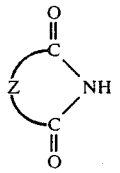

wherein Z represents the atoms necessary to complete a substituted or unsubstituted hydantoin compound.

2. An image recording element as in claim 1 wherein said cyclic imide melt former-silver solvent is 5,5-diphenylhydantoin, 5,5-dimethylhydantoin or hydantoin.

3. An image recording element as in claim 1 wherein said silver compound is photographic silver halide.

4. An image recording element as in claim 1 wherein said silver compound is photographic silver halide and said element comprises a hindered phenol or blocked hydroquinone silver halide developing agent precursor.

5. An image recording element as in claim 1 wherein said silver compound is photographic silver halide and said element comprises a silver halide developing agent precursor selected from the group consisting of compounds represented by the formula:

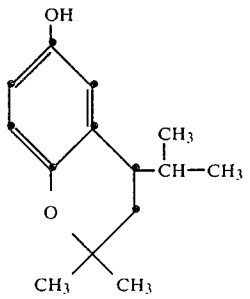

and

-continued

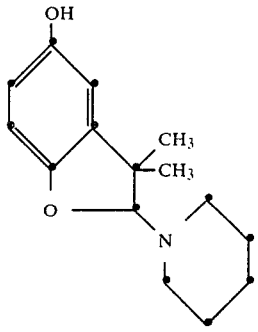

and combinations thereof.

6. In a heat developable photographic element comprising a support bearing, in reactive association, (I) a layer comprising, in a binder, a cobalt imaging combination comprising (i) a cobalt (III) amine complex and (ii) an aromatic 1,2-dialdehyde capable of reacting upon processing with ammonia or an amine to form a dye, and (II) a photographic silver halide poly(vinyl butyral) emulsion layer, the improvement comprising a hydantoin melt-former-silver halide solvent capable of promoting dye formation in said element at a temperature within the range of about 80° C. to about 200° C.

7. In a heat developable imaging assemblage comprising a support bearing, in reactive association, (I) a layer comprising, in a binder, a cobalt imaging combination comprising (i) a cobalt (III) amine complex, with (ii) an aromatic 1,2-dialdehyde capable of reacting with ammonia or an amine to form a dye; and (II) a layer comprising a silver image; the improvement comprising a hydantoin melt former-silver solvent capable of promoting dye formation in said element at a temperature within the range of about 80° C. to about 200° C.

8. In a heat developable imaging assemblage as in claim 7 wherein said hydantoin melt-former-silver solvent is 5,5-diphenylhydantoin, 5,5-dimethylhydantoin or hydantoin.

9. In a heat developable imaging assemblage comprising a support bearing, in reactive association, (I) a layer comprising, in a binder, a cobalt imaging composition comprising (i) cobalt (III) ammine complex with (ii) phthalaldehyde; and, (II) a layer comprising a silver image, the improvement comprising, a melt former-silver halide solvent consisting essentially of 5,5-diphenylhydantoin or 5,5-dimethylhydantoin.

10. A method of developing a silver image and dye image in a heat developable imaging element as defined in claim 1, said method comprising heating said element to a temperature within the range of about 80° C. to about 200° C. until said silver image and said dye image are formed.

11. A method of forming a dye image in a heat developable imaging assemblage as defined in claim 7, said method comprising heating said assemblage at a temperature within the range of about 80° C. to about 200° C. until said dye image is formed.

* * * * *